US005613681A

United States Patent [19]

Allen

[11] Patent Number: 5,613,681

[45] Date of Patent: Mar. 25, 1997

[54] STRATEGY GAME WITH TWO OR THREE DIMENSIONAL MATRIX AND BALLS

[76] Inventor: Dillis V. Allen, 31W211 Rte. 58, Elgin, Ill. 60120

[21] Appl. No.: 545,511

[22] Filed: Oct. 19, 1995

[51] Int. Cl.[6] ..... A63F 3/00

[52] U.S. Cl. ..... 273/271; 273/241; 273/283; 273/153 R; 446/118

[58] Field of Search ..... 273/153 R, 153 S, 273/156, 157 R, 157 A, 241, 264, 271, 275, 276, 283, 287; 446/87, 105, 118, 119, 120, 121

[56] References Cited

U.S. PATENT DOCUMENTS 3,695,614 10/1972 Brisson ..... 273/241
3,747,931 7/1973 Tuan ..... 273/283

FOREIGN PATENT DOCUMENTS 562487 5/1975 Switzerland ..... 273/241

*Primary Examiner*—William M. Pierce

[57] ABSTRACT

A strategy game with the flavor of Tic Tac Toe embodied in both two dimensional(planar) and three dimensional (cubic) configurations. Each consists of a lattice type matrix forming a plurality of interconnected adjacent open cubes. The playing members are spherical and player differentiated by color. These player balls are inserted into the matrix alternately by the players and scoring is achieved by ball patterns; e.g., three in a row or nine in a single plane. The uniqueness in this game is the ability of the player balls to move from one cube to another in the matrix by the players forcing one ball against another. This capability dramatically increases scoring and blocking opportunities.

15 Claims, 4 Drawing Sheets

Fig. 2
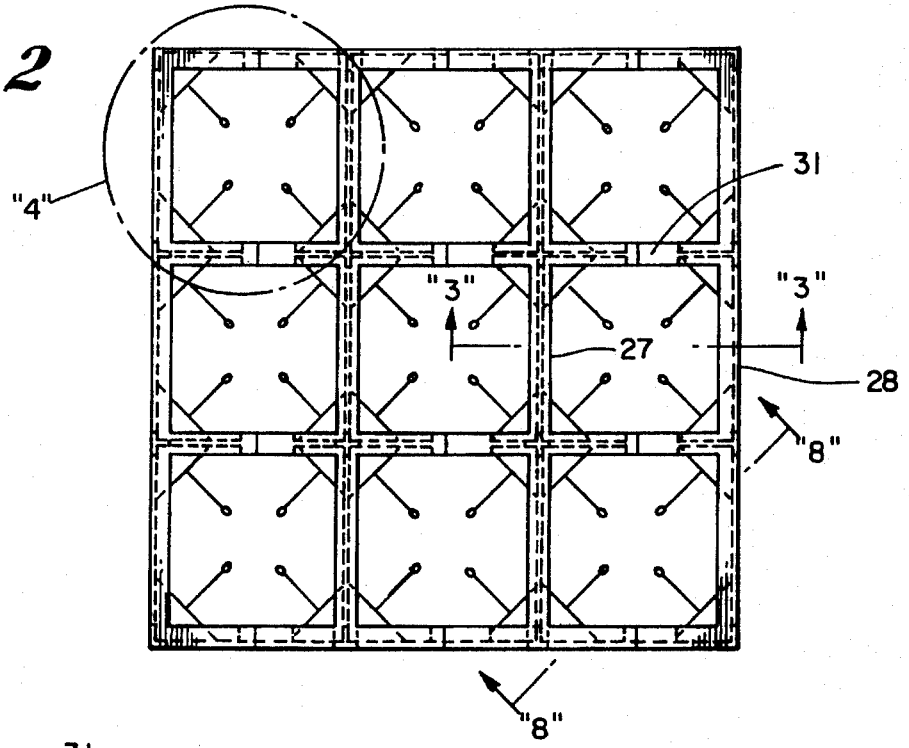
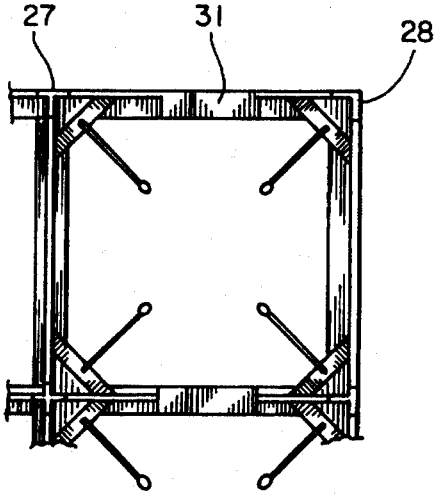
Fig. 3
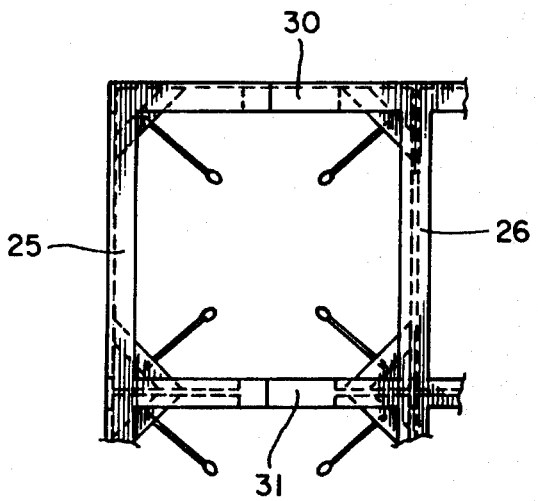
Fig. 4

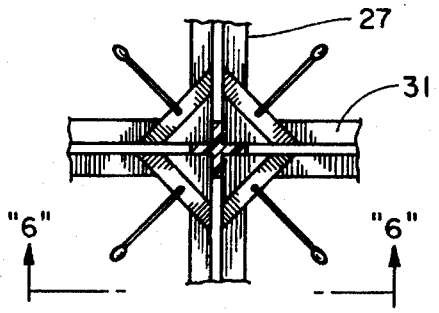
Fig. 5
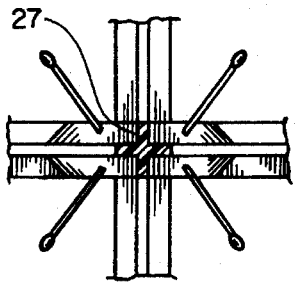
Fig. 6
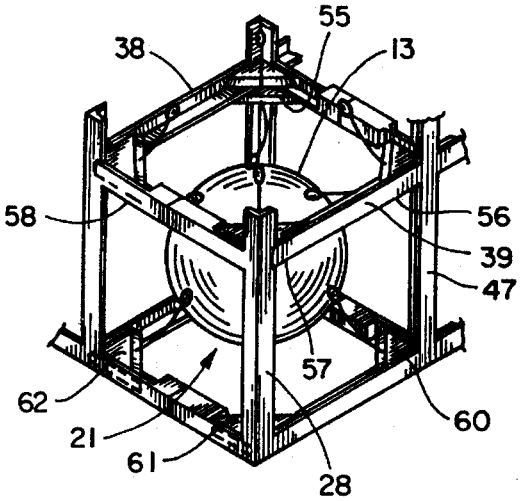
Fig. 7
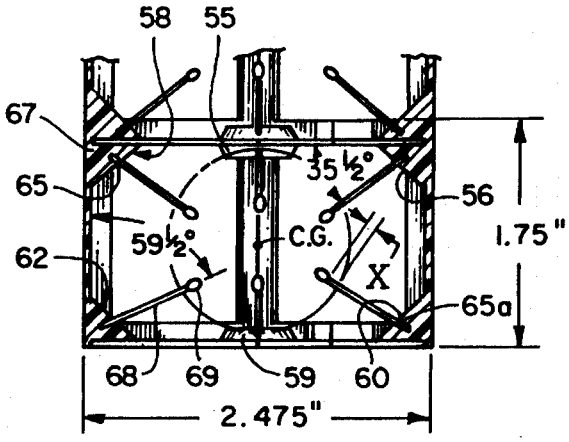
Fig. 8
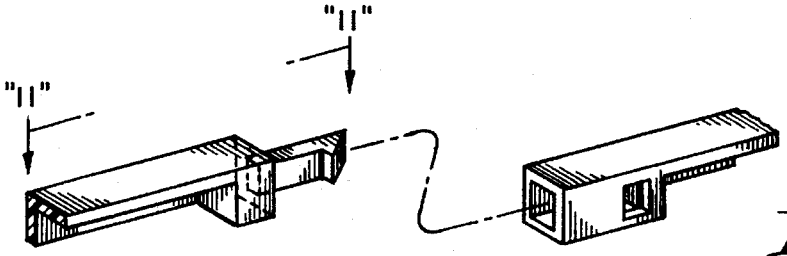
Fig. 9
Fig. 10
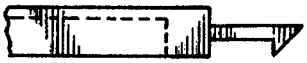
Fig. 11

STRATEGY GAME WITH TWO OR THREE DIMENSIONAL MATRIX AND BALLS

BACKGROUND OF THE INVENTION

There have in the past been provided a plurality of games that might be considered Tic Tac Toe type games in which scoring is achieved by positioning a certain number of player members in a straight line. For example, the game THROW IN A ROW™ manufactured by Tonka Corporation consists of three vertical tubes each with a funnel at the top into which the players toss balls to achieve scoring patterns. The CONNECT FOUR manufactured by Hasbro, Inc. has been an extremely successful game and includes a plurality of vertical slots formed in a single plane into which the players alternately drop checker-like player members in an effort to achieve four player members in a row either diagonally, horizontally or vertically. A game called IN THE DARK™ manufactured by Parker Brothers is similar to the CONNECT FOUR game.

In each of the THROW IN THE ROW™, CONNECT FOUR, and IN THE DARK™ games, the strategy component is relatively low because once the player members achieve a certain position in the slots they are not movable from that position at any time later in the game.

The SHIFT TAC TOE™ planar game manufactured by Pressman, Inc. does include nominal shifting of elements. In this game a plurality of vertical slots are formed in a single plane device and the player members, like the CONNECT FOUR game are dropped in from the top. Horizontal shifting is accomplished by levers along the side edges.

A MAKE 7™ also manufactured by Pressman, Inc. is similar to the CONNECT FOUR and THROW IN A ROW™.

Less commercially successful games have been the subject of many United States and foreign patent applications. For example, the Housley, U.S. Pat. No. 2,773,690, the Tuan, U.S. Pat. No. 3,747,931, and the Unique, U.S. Pat. No. 4,143,878 all disclose three dimensional Tic Tac Toe type games where the player-members, once positioned in the matrix cannot thereafter be moved without removing the members from the matrix itself.

The Swiss, CH Patentschrift 562,487 issued Jun. 7, 1974 and the Canadian Patent 602,970 issued Aug. 9, 1960 both show lattice-type matrix games in which resilient balls are held in position by the lattice framework itself. This design requires that the balls have a larger diameter than the cube in which it is held and be made from a cushion material and because of this it is not possible to shift the balls from one cube to another within the matrix.

The United Kingdom patent application GB 2,198,359 published Jun. 15, 1988 shows a block-like game that falls in the category of the immovable three dimensional games discussed above.

The Replogle, U.S. Pat. No. 3,888,487 shows a three dimensional Tic Tac Toe game in which it is possible to move the spherical player members through the matrix. However, this requires the use of an elongated tool 24 to move the members through the matrix and because the ball locations within the matrix are separated by a distance equal to approximately three times the diameter of the ball itself, it is not possible to utilize the tool 24 to force more than one ball at a time from one location to another. That is, if the tool is utilized to force one ball against another, only the ball engaging the ball will be appropriately positioned and the ball forced by that ball will be in a no-man's land location between ball position.

The Breslow, U.S. Pat. No. 3,705,727, the Hyland, et al., U.S. Pat. No. 4,440,395 and the Palladino, U.S. Pat. No. 4,620,709 show similar game configurations that should be viewed by the reader to complete the appropriate background prior art but are not believed more relevant than any of the patents specifically commented on above.

It is a primary object of the present invention to provide a unique Tic Tac Toe game that ameliorates the problems and limitations of presently marketed or previously patented games of this type.

SUMMARY OF THE PRESENT INVENTION

In accordance with the present invention, a unique strategy game is provided with the flavor of Tic Tac Toe embodied in both two dimensional(planar) and three dimensional (cubic) configurations. Each consists of a lattice-type matrix forming a plurality of interconnected adjacent open cubes. The player members are rigid and spherical and player differentiated by color. The player balls are inserted into the matrix alternately by the players and scoring is achieved by ball patterns of three in a row or nine in a single plane. The uniqueness of this game is the ability of the player balls to move from one cube to another in the matrix by the players forcing one ball against another. This capability dramatically increases scoring and blocking opportunities over the games described above in the Background of Invention.

The capability of the player balls, which are rigid and similar to ping pong balls, to move freely through the matrix from one individual cube to one of the adjacent cubes by forcing one ball against another, is achieved by the relationship between the diameter of the player balls and the size of the cube and the plurality of holding elements in each cube that hold the balls centrally in the cube and yet permit the ball when engaged by another ball to be shifted from that cube and snapped into the holding elements in the adjacent cube. Firstly, the rigid player balls have a diameter slightly less than the length of the cube size, and of course, all of the cubes have identical geometric configurations.

Each cube, by definition, has eight corners and in each of these is a tine boss that has a flat outer surface with a hole therein having an axis that intersects the geometric center of the cube. A flexible plastic tine with a small hard and smooth spherical end is staked in each of these eight holes, and thus they all project toward the geometric center of the cube. The length of the tine is selected so that it extends a substantial distance toward the geometric center of the cube beyond the outer surface of the ball when positioned centrally within the cube. This relationship results in the tines bending around the ball and engaging the outer surface of the ball over a substantial length of the sides of the tines themselves. The tines are constructed of an elastomeric material having a substantial "memory" so that when the balls leave the cubes, the tines return to their linear configuration pointing toward the geometric axis of the cube.

In the two dimensional configuration of this game, the cubes may be arranged within the lattice either three on a side(9 cubes) or five on a side(25 cubes), all in a single plane.

In the three dimensional version, which is depicted in the drawings, the cubes are preferably arranged three on a side thereby totaling 27 in an overall cubic arrangement, thereby totaling 27 individual cubes.

An important aspect of the present invention is that it is designed to be manufactured and assembled in four layers utilizing only two tools(cavities). The outer two layers utilize the identical part rotated 180 degrees about a vertical axis and the two inner layers are identical to one another and assembled without rotation. Thus, only two tools are required to manufacture the entire matrix. This is achieved by a unique arrangement of male and female connectors about the individual layers that permit the four layers when appropriately positioned to be snapped together during assembly. Of course, prior to snapping the layers together the tines are staked within the apertured bosses formed integrally with each plastic molded layer.

Other objects and advantages of the present invention will appear more clearly from the following detailed description.

BRIEF DESCRIPTION OF THE DRAWINGS

FIG. 2 is a side view of the three dimensional matrix illustrated in FIG. 1;

FIG. 3 is a cross section of one cube taken generally along line 3—3 of FIG. 2;

FIG. 4 is a fragmentary view of one of the corner cubes taken generally at line 4 in FIG. 2;

FIG. 5 is a fragmentary section of a common corner of four adjacent cubes;

FIG. 6 is a bottom view of the fragmentary section illustrated in FIG. 5;

FIG. 7 is a fragmentary perspective of one corner cube illustrating the ball in position with the eight tines engaging and centering the player ball;

FIG. 8 is a diagonal section through one cube taken generally along line 8—8 of FIG. 2;

FIGS. 9 and 10 are exploded enlarged fragmentary sections in prospective of an exemplary pair of male and female connectors in the matrix;

FIG. 11 is a side view of the male connector illustrated in FIG. 9, and;

DETAILED DESCRIPTION OF THE PREFERRED EMBODIMENTS

Figure 1:
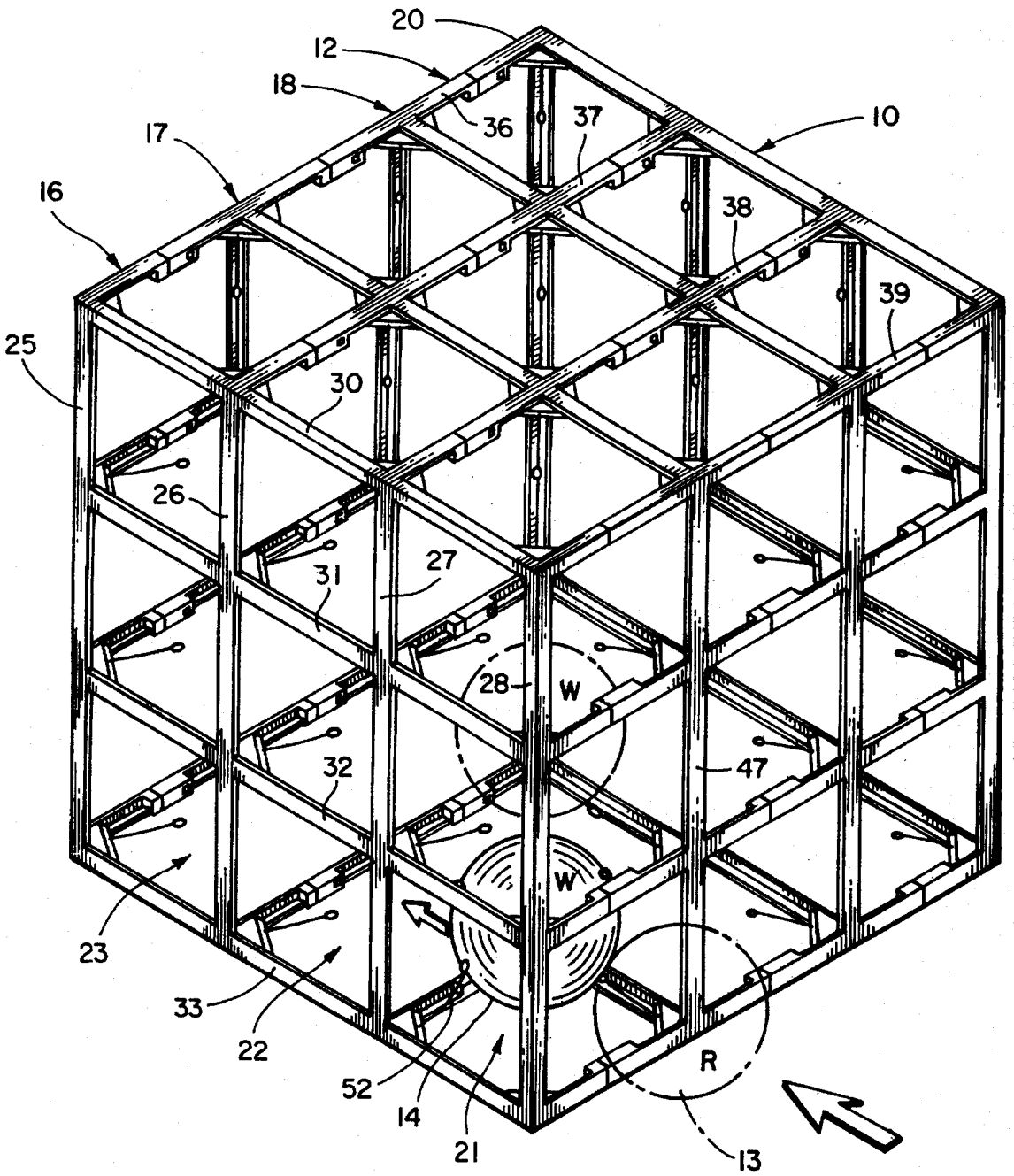
FIG. 1 is a perspective view of the three dimensional configuration of the present game illustrating two balls within the matrix and one entering.

Referring to the drawings and particularly FIG. 1, a first embodiment of the present strategy game 10 is illustrated consisting of a three dimensional lattice-like matrix 12, 14 first player balls(R) 13, and 14 second player balls(W) 14. The three dimensional embodiment illustrated in FIGS. 1 through 12 is the preferred embodiment of the present invention wherein the lattice network 12 includes 27 adjacent cube areas, three on each leg of the matrix 12.

However, the present invention can be embodied in a simpler form with all of the cubic areas in a single plane, for example, one of the three planes illustrated in FIG. 1 with three cubical areas along the top and the side forming a total of nine cubical areas. There could, in this planar embodiment, also be twenty-five cubical areas formed five on the side, all in a single plane. While the two dimensional planar version of the present invention is considerably simpler both to manufacturer and in its skill level, it nevertheless has some of the benefits of the present invention, namely the ability to move the player balls through the plane from one cubic area to another.

Figure 12:
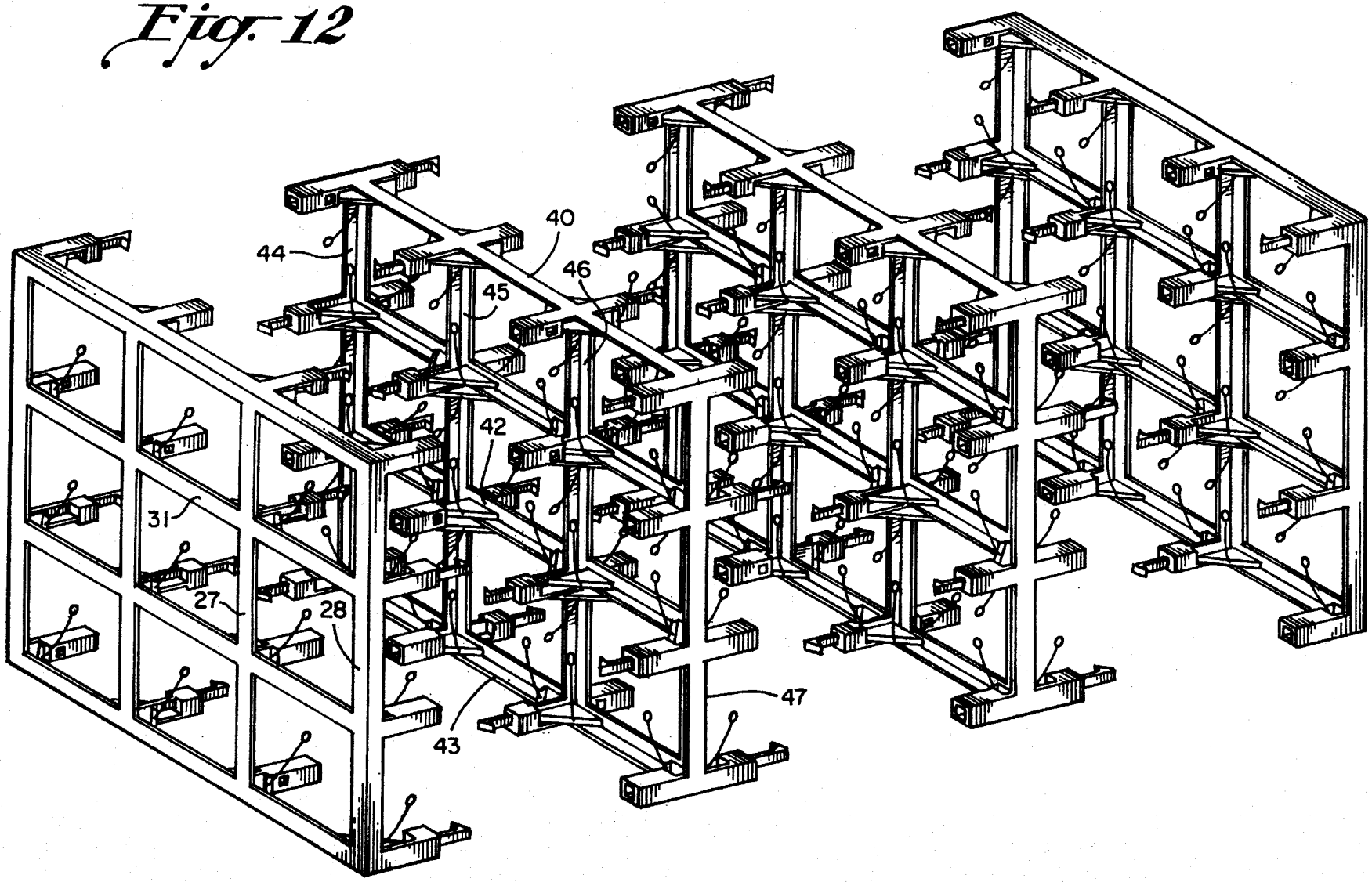
FIG. 12 is an exploded perspective illustrating the four layers comprising the matrix illustrated in FIG. 1.

Returning to the preferred embodiment and particularly the matrix 12 illustrated in FIG. 1, it is constructed of four layers of injection molded plastic parts snapped together as seen in FIG. 1 utilizing a first molding for both end panels and a second molding for both middle panels as will be described further in connection with FIG. 12. In any event, the lattice matrix 12 includes a first vertical layer 16, a second vertical layer 17, a third vertical layer 18 identical to vertical layer 17, and a fourth vertical layer 20 identical to first vertical layer 16. (The term "vertical" is solely for description since matrix 12 can be positioned with any side as its bottom).

The layers 16, 17, 18 and 20 form a matrix of twenty-seven cubic areas such as indicated at 21, 22 and 23 in FIG. 1 along the lower front row of the matrix illustrated in FIG. 1. It should also be understood that the internal lattice network has been removed from the interior of the matrix 12 in FIG. 1 solely for the purpose of clarity and to avoid confusing the reader with a great many overlapping parts. All of these internal cross members however are illustrated in FIG. 12 so that the internal geometry and construction of all twenty-seven cubes within the matrix are identical to one another and the following description of a single cubic area will be appreciated to apply to all twenty-seven in the matrix.

The lattice matrix 12 includes sixteen narrow vertical stringers 25, 26, 27, 28(four in each of four spaced parallel planes) interconnected by sixteen horizontal stringers 30, 31, 32 and 33(four in each of four spaced parallel planes), and sixteen orthogonally related horizontal stringer members 36, 37, 38 and 39 also arranged in each of four spaced parallel planes.

Turning now to the internal construction of each of the cubic areas 21, 22 and 23 and viewing FIGS. 2 to 8 and initially FIGS. 7 and 8, each geographic area has four equal sides, each having a length A illustrated in FIG. 8. In one exemplary embodiment, the distance A is 1.75 inches which of course is the medial distance between the parallel stringers illustrated in FIG. 1. That is, that distance A is taken from the mid-point of the stringer as opposed to its outer edges. In this exemplary embodiment the dimension A is 1.75 inches and the diameter of the player spheres or balls, such as sphere 13 indicated in FIGS. 7 and 8 is 1.50 inches. While the specific dimensions of the cubic areas is not critical to the present invention, the relationship between the leg dimension A and the diameter of the spherical player member 13 is very important to the present invention. Utilizing the dimensions just given, the ratio of the diameter of the player spheres $D^B$ to the length of side $A(L_A)$ is 0.857 inches. In the present invention, this will work satisfactorily within a range of plus or minus 20% of that ratio by the appropriate selection of the length, diameter, durometer and certain other characteristics of the plastic tines.

Viewing FIGS. 7 and 8, each of the eight corners of cubic area 21 has a tine mounting boss, including upper mounting bosses 55, 56, 57 and 58 and lower mounting bosses 59, 60, 61 and 62. Reference should be made now to FIG. 8 for an explanation of the geometry of the mounting bosses as well as the geometry of the tines themselves, and in this regard it should be kept in mind that FIG. 8 is taken on a vertical diagonal plane through FIG. 7. In this regard note that in FIG. 8, because it is a diagonal section through the cubic area, the horizontal diagonal dimension of the cubic area is greater than the vertical dimension (A=1.75 inches). Each of the tine bosses has an aperture 65 therein having an axis that is co-linear with a line passing therethrough, through the geometric center of the cubic area designated G.C. in FIG. 8, and also through the same bore 65 in the diagonally opposite boss. For example, the boss 58 has a bore 65 therein that has an axis passing through the geometric center(G.C.) of the geometric area and also passing through the axis of the bore 65(*a*) in diagonal boss 60. Each of the bosses has a planar forward surface 67 that is perpendicular to the axes of the tine bore 65.

Each of the tine bores 65 has a flexible elastomeric tine 68 therein staked with a separate short length of plastic rod(not shown) approximately the same diameter as the tines themselves. Each of the tines has a rigid smooth tip 69 dip-molded on the distal ends thereof constructed of a significantly more rigid material than the tines themselves. The tines 68 are cut from a continuous wound drum of plastic elastomeric "wire" having a substantial "memory" characteristic. These materials, as well as the staking technique, are known in the present day hairbrush art, and while the application of these tines to the present lattice structures is believed unique, the details of staking the tines into the apertures 65 and the chemical composition of the tines themselves can be derived from the hairbrush art.

In addition to the important ratio of the diameter of the player balls 13 to the length of the cubic area side dimension A(1.75 inches), the ratio of the length of the tine 68, including the tips 69, to the diameter of the player balls 13 is also important. In this regard, and again viewing FIG. 8, the length of the tine 68 is selected so that in the diagonal plane of FIG. 8, each of the tines extends a substantial distance X toward the geometric center of the cubic area beyond the periphery or outer surface of the player balls 13. While distance X in FIG. 8 appears small, it is actually much greater because the tines in FIG. 8 are bent against the outer surface of the ball. From the dimensions illustrated in FIG. 8, dimension X is in the range of 0.125 to 0.30 inches depending upon the thickness and durometer of the tines.

This relationship between tine length and the diameter of the player ball assures that the tine will bend over a substantial distance as shown in FIG. 7 so that when a ball is positioned in the cubic area, portions of the sides of each tine in addition to the semi-spherical tip 69 actually engage the outer surface of the player ball 13. This relationship assures that the player ball 13 when pushed into the cubic area will snap into a position centrally in the cubic area. Furthermore, this relationship also assures that the player balls can be displaced from one cubic area into another cubic area with approximately the same force as it takes to enter any cubic area.

I claim:

1. A strategy game, comprising: a matrix of areas extending at least two dimensionally in X and Y directions including at least three generally cubic areas in the X direction and at least three connected and adjacent generally cubic areas in the Y direction each having a width, height and depth, a plurality of rigid spherical first player members and a plurality of rigid spherical second player members all having diameters equal to or less than the width, height and depth of the cubic areas, and flexible means projecting into each of the cubic areas to hold the player members in each of the areas and permit the player members to be displaced from the areas in either X or Y directions by engagement of one player member against another player member without tools.

2. A strategy game as defined in claim 1, wherein the flexible means to hold the player members in each of the areas and permit the player members to be displaced from the areas in either X or Y directions including a plurality of flexible members in each of the areas engageable with the player members.

3. A strategy game, comprising: a matrix of areas extending at least two dimensionally in X and Y directions including at least three areas in the X direction and at least three connected and adjacent areas in the Y direction, a plurality of first player members and a plurality of second player members, and means to hold the player members in each of the areas and permit the player members to be displaced from the areas in either X or Y directions by engagement of one player member against another player member without tools, the means permitting the player members to be held in each of the areas and permitted to be displaced from the areas in either X or Y directions including a plurality of flexible members in each of the areas engageable with the player members, the player members are rigid and spherical and said areas being generally cubic with each cubic area having a center, said flexible members including at least eight flexible members, one projecting from each corner of a cubic area and extending generally toward the center of the cube.

4. A strategy game as defined in claim 3, wherein the flexible members are constructed of an elastomeric material having substantial memory characteristics, said player members having an outer surface, each of the flexible members extending toward a center of the generally cubic area a substantial distance greater than the outer surface of the spherical player members when positioned centrally in the cubic area.

5. A strategy game, comprising: a matrix of areas extending at least two dimensionally in X and Y directions including at least three areas in the X direction and at least three connected and adjacent areas in the Y direction, a plurality of first player members and a plurality of second player members, and means to hold the player members in each of the areas and permit the player members to be displaced from the areas in either X or Y directions by engagement of one player member against another player member without tools, the means permitting the player members to be held in each of the areas and permitted to be displaced from the areas in either X or Y directions including a plurality of flexible members in each of the areas engageable with the player members, the flexible members having generally spherical tips on a distal end thereof.

6. A strategy game, comprising: a matrix of generally cubic areas extending at least in X and Y directions with each cubic area each having a center and a width, height and depth, including at least three areas in the X direction and at least three areas in the Y direction, a plurality of rigid spherical first player members and a plurality of rigid spherical second player members each having diameters less than the width, height and depth of the cubic areas, and flexible means in each of the cubic areas to hold the player members in each of the areas and permit the player members to be displaced from the areas in either X or Y directions by engagement of one player member against another player member without tools, including a plurality of flexible members in each of the cubic areas engageable with the player members to hold the player members substantially centrally in each of the cubic areas but to permit the player members to be released from their cubic areas when pushed by another player member in either X or Y directions.

7. A strategy game, comprising: a matrix of generally cubic areas extending at least in X and Y directions including at least three areas in the X direction and at least three areas in the Y direction, a plurality of rigid spherical first player members and a plurality of rigid spherical second player members, and means to hold the player members in each of the cubic areas and permit the player members to be displaced from the cubic areas in either X or Y directions by engagement of one player member against another player member without tools, including a plurality of flexible members in each of the cubic areas engageable with the player members to hold the player members substantially centrally in each of the cubic areas but to permit the player members to be released from their cubic areas when pushed by another player member in either X or Y directions, said flexible members including at least eight flexible members, one projecting from each corner of cubic area and extending generally toward a center of the cubic area.

8. A strategy game as defined in claim 7, wherein the flexible members are constructed of an elastomeric material having substantial memory characteristics, each of the flexible members extending toward the center of the generally cubic area a substantial distance from the outer surface of the spherical player members when positioned centrally in the cubic area.

9. A strategy game, comprising: a matrix of generally cubic areas extending at least in X and Y directions including at least three cubic areas in the X direction and at least three cubic areas in the Y direction, a plurality of rigid spherical first player members and a plurality of rigid spherical second player members, and means to hold the player members in each of the cubic areas and permit the player members to be displaced from the cubic areas in either X or Y directions by engagement of one player member against another player member without tools, including a plurality of flexible members in each of the cubic areas engageable with the player members to hold the player members substantially centrally in each of the cubic areas but to permit the player members to be released from their cubic areas when pushed by another player member in either X or Y directions, the flexible members having generally spherical tips on a distal end thereof.

10. A strategy game, comprising: a matrix of generally cubic areas extending at least in X and Y directions with each cubic area having a center, including at least three areas in the X direction and at least three cubic areas in the Y direction, a plurality of rigid spherical first player members and a plurality of rigid spherical second player members, and means to hold the player members in each of the cubic areas and to permit the player members to be displaced from the cubic areas in either X or Y directions by engagement of one player member against another player member without tools, including a plurality of flexible members in each of the cubic areas engageable with the player members to hold the player members substantially centrally in each of the cubic areas but permit the player members to be released from their cubic areas when pushed by another player member in either X or Y directions, said flexible members including at least eight flexible members, one projecting from each corner of the cubic area and extending generally toward the center of the cubic area, wherein the flexible members are constructed of an elastomeric material having substantial memory characteristics, each of the flexible members extending toward the center of the generally cubic area a substantial distance from an outer surface of the spherical player members when positioned centrally in the cubic area.

11. A three dimensional strategy game, comprising: a lattice matrix of adjacent cubic areas including at least three cubic areas in the X direction, at least three cubic areas in the Y direction and at least two cubic areas in the Z direction with each cubic area having a center, a plurality of spherical first player members, a plurality of spaced second player members, all the player members being light weight and of equal diameter, each of the cubic areas having openings on all six sides sufficient to pass a player member therethrough, and means to hold the player members in each of the cubic areas and to permit the player members to be displaced from the cubic areas in each of the X, Y and Z directions by engagement of one player member against another including a flexible tine at each of the corners of each of the cubic areas engageable with the player members and extending toward the geometric center of the cubic area a distance substantially greater than the radius of a player member when positioned centrally in a cubic area.

12. A three dimensional strategy game as defined in claim 11, wherein there are at least three cubic areas in the Z direction.

13. A three dimensional strategy game as defined in claim 11, wherein said flexible tines include at least eight flexible tines, one projecting from each corner of the cube and extending generally toward the center of the cube.

14. A three dimensional strategy game as defined in claim 13, wherein the flexible tines are constructed of an elastomeric material having substantial memory characteristics.

15. A strategy game, comprising: a matrix of areas extending at least two dimensionally in X and Y directions including at least three areas in the X direction and at least three connected and adjacent areas in the Y direction, first, second, third and fourth spaced parallel planar lattice networks, means to hold the player members in each of the areas and permit the player members to be displaced from the areas in either X or Y directions by engagement of one player member against another player member without tools, said first, second, third and fourth planar lattice network having at least four vertical stringers interconnected by at least four horizontal stringers, means for attaching the first planar lattice network in spaced parallel relation to the second planar lattice network, the second planar lattice network to the third planar lattice network, and the third planar lattice network to the fourth planar lattice network, including a plurality of male or female connectors projecting orthogonally from planar lattice networks, said first and fourth planar lattice networks being identical in construction, and said second and third planar lattice networks being identical in construction whereby a single production tool is required to make both the first and fourth planar lattice networks and a single production tool is required to make both the second and third planar lattice network.

* * * * *